US006945837B2

(12) United States Patent
Crumrine et al.

(10) Patent No.: US 6,945,837 B2
(45) Date of Patent: Sep. 20, 2005

(54) WAKEBOARD BINDING PLATE ASSEMBLY AND METHOD OF USE

(75) Inventors: Scott Crumrine, Carlsbad, CA (US); James J Redmon, Carlsbad, CA (US); Kyle Schmidt, Clermont, FL (US)

(73) Assignee: Motion Water Sports, Inc., Redmond, WA (US)

( * ) Notice: Subject to any disclaimer, the term of this patent is extended or adjusted under 35 U.S.C. 154(b) by 0 days.

(21) Appl. No.: 10/900,333

(22) Filed: Jul. 28, 2004

(65) Prior Publication Data

US 2005/0032442 A1 Feb. 10, 2005

Related U.S. Application Data

(60) Provisional application No. 60/493,456, filed on Aug. 8, 2003.

(51) Int. Cl.[7] ..... B63B 35/85

(52) U.S. Cl. ..... 441/70; 280/607; 280/613; 280/620

(58) Field of Search ..... 441/65, 70, 74, 441/75; 280/607, 613, 618, 620

(56) References Cited

U.S. PATENT DOCUMENTS

| | | | | | |
|---|---|---|---|---|---|
| 5,021,017 | A | | 6/1991 | Ott | 441/70 |
| 5,236,216 | A | * | 8/1993 | Ratzek | 280/607 |
| 5,277,635 | A | * | 1/1994 | Gillis | 441/74 |
| 5,499,837 | A | | 3/1996 | Hale et al. | 280/607 |
| 5,553,883 | A | * | 9/1996 | Erb | 280/607 |
| 5,791,678 | A | | 8/1998 | Perlman | 280/618 |
| 6,318,749 | B1 | * | 11/2001 | Eglitis et al. | 280/607 |
| 6,499,757 | B1 | | 12/2002 | Berger et al. | 280/607 |
| 2003/0011171 | A1 | | 1/2003 | Battistella | 280/618 |

* cited by examiner

*Primary Examiner*—Lars A. Olson
(74) *Attorney, Agent, or Firm*—Clark & Brody

(57) ABSTRACT

A wakeboard binding plate assembly includes a disc and ring. The disc is sized to fit within the opening of the ring, with each of the disc and ring including irregular surfaces, respectively positioned to engage each other. The disc is mounted to a portion of a boot assembly of the wakeboard. The ring is adapted to be fastened to a wakeboard, with the disc held in place between the disc and a boot assembly for the wakeboard, engagement between the irregular surfaces of the disc and the ring preventing rotation of the disc. Loosening the ring allows the disc to rotate so that the boot assembly can be easily moved to a desired alignment.

19 Claims, 3 Drawing Sheets

WAKEBOARD BINDING PLATE ASSEMBLY AND METHOD OF USE

This application claims priority under 35 USC 119(e) based on provisional patent application No. 60/493,456 filed on Aug. 8, 2003, which is herein incorporated by reference in its entirety.

FIELD OF THE INVENTION

The present invention is directed to an improved wakeboard binding plate assembly, and particularly to a wakeboard binding plate assembly that facilitates easy adjustment of the alignment of the feet of a wakeboard user.

BACKGROUND ART

In the prior art, various types of bindings are used for wakeboards. One desirable feature of these bindings is adjustability so that a user can orient the bindings in a particular direction. One type uses a boot assembly, which includes the various components necessary to retain a user's feet to the wakeboard. The boot assembly is mounted to a base plate or the like, with the base plate being movable. An example of this type of binding is shown in U.S. Pat. No. 5,021,017 to Ott. However, the present day adjustable bindings are often complicated in design or are not easily adjusted.

While bindings are also employed for snowboards, these bindings are not suited for wakeboards, since the snowboard bindings are designed so that the boot is removable from the binding assembly. In contrast, the boot assembly of the wakeboard stays on the wakeboard, with the user removing his foot from the wakeboard boot.

As such, a need exists for improved adjustability for wakeboard bindings. The present invention responds to this need through an improved binding plate assembly that permits easy and quick adjustment of the orientation of the wakeboard binding.

SUMMARY OF THE INVENTION

A first object of the invention is an improved wakeboard binding plate assembly.

Another object of the invention is a wakeboard binding using the inventive binding plate assembly.

A further object of the invention is a method of easily and quickly adjusting the orientation of a wakeboard binding.

Other objects and advantages will become apparent when reviewing the description below.

In satisfaction of the foregoing objects and advantages, the invention is an improvement in a wakeboard binding In a wakeboard binding having a base plate and a boot assembly, wherein the base plate is adapted to attach to a wakeboard, the invention provides a ring defining a central opening, and at least a pair of opposing throughholes. The ring has top and bottom surfaces, a portion of bottom surface at an edge of the central opening having a first irregular surface. The ring is adapted to be secured to the wakeboard using the opposing throughholes. Also provided is a disc sized larger than the central opening and having top and bottom surfaces. A portion of the top surface of the disc at a peripheral edge thereof has a second irregular surface. The disc includes means to permit attachment to the boot assembly, the first and second irregular surfaces adapted to engage each other when the ring is secured to the wakeboard.

The ring can have opposing sets of throughholes to facilitate attachment to the wakeboard, and optionally, the ring can be formed with opposing ear portions with the throughholes in the ear portions to ease access to the means for attachment.

While the irregular surfaces can take on any type of mutually engaging shape, one embodiment of the invention employs a set of teeth. Further, the means for attaching the disc to boot assembly includes a number of openings and fasteners. Likewise, fasteners can be employed to attach the ring to the wakeboard, the fasteners configured with enlarged heads to make it easy for grasping by a user when the user's feet are in the wakeboard bindings.

While the invention is an improvement in wakeboard bindings, the invention also includes just the combination of the ring and disc.

The invention also entails a method of positioning the wakeboard binding on a wakeboard. The method comprises the steps of providing the inventive binding plate assembly described above as part of the wakeboard binding. The disc of the assembly is attached to a boot assembly of the binding with the ring disposed between the boot assembly and the disc. The ring is then attached to the wakeboard so that the first and second irregular surfaces of the disc and ring engage each other to retain the disc and boot assembly in a desire place for wakeboard use.

Once the disk and boot assembly are positioned in a desired orientation, the wakeboard can be used in its normal fashion. If adjustment is required, the ring can be loosened or removed from the wakeboard, and the disc can then be rotated into another position with respect to the ring. Once the desired new position is located, the ring can be re-attached or retightened to permit continued use of the wakeboard.

DESCRIPTION OF THE PREFERRED EMBODIMENTS

Figure 1:
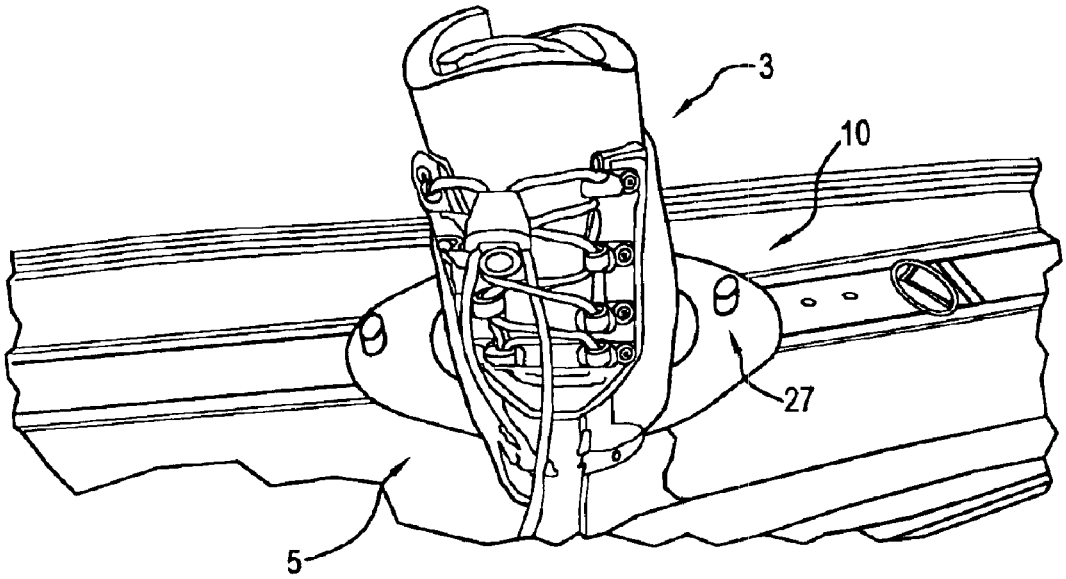
FIG. 1 is a perspective view of a first embodiment of the inventive binding plate assembly mounted on a wakeboard.

The inventive binding plate for a wakeboard binding offers significant advantages over the prior art binding plates and adjustable mechanisms. A boot assembly using the inventive binding plate assembly is easily rotated by merely loosening the ring that holds the boot assembly and the disc attached thereto. This adjustment can be done while the user's foot is in the boot assembly. This is much simpler than systems requiring complicated components, or special wakeboard designs.

Referring now to FIGS. 1–4, the inventive binding plate is designated by the reference numeral 10 and is seen attached to a wakeboard 1 and supporting a boot assembly 3. The boot assembly 3 is exemplary and virtually any type of boot assembly can be used with the binding plate assembly of the invention.

Figure 2:
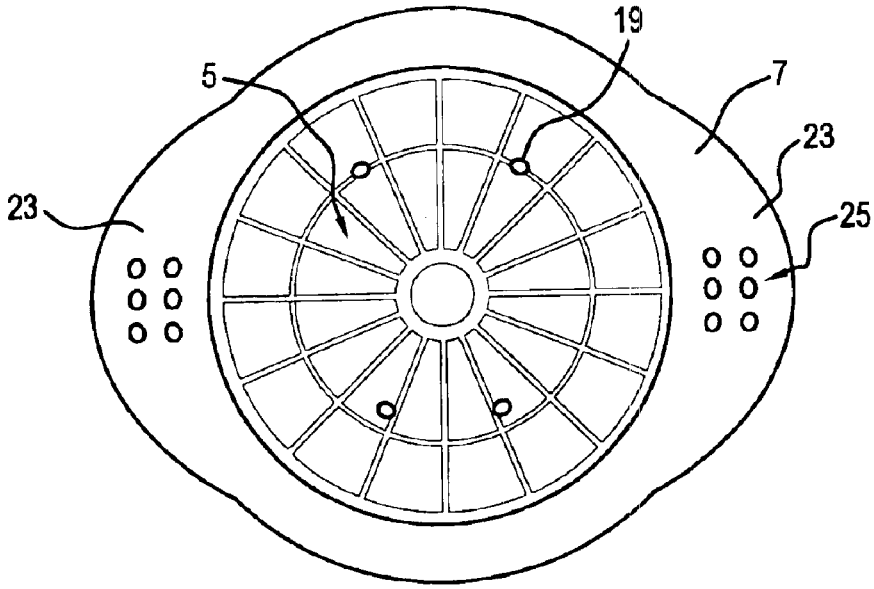
FIG. 2 is a top view of the binding plate assembly of FIG. 1.
Figure 3:
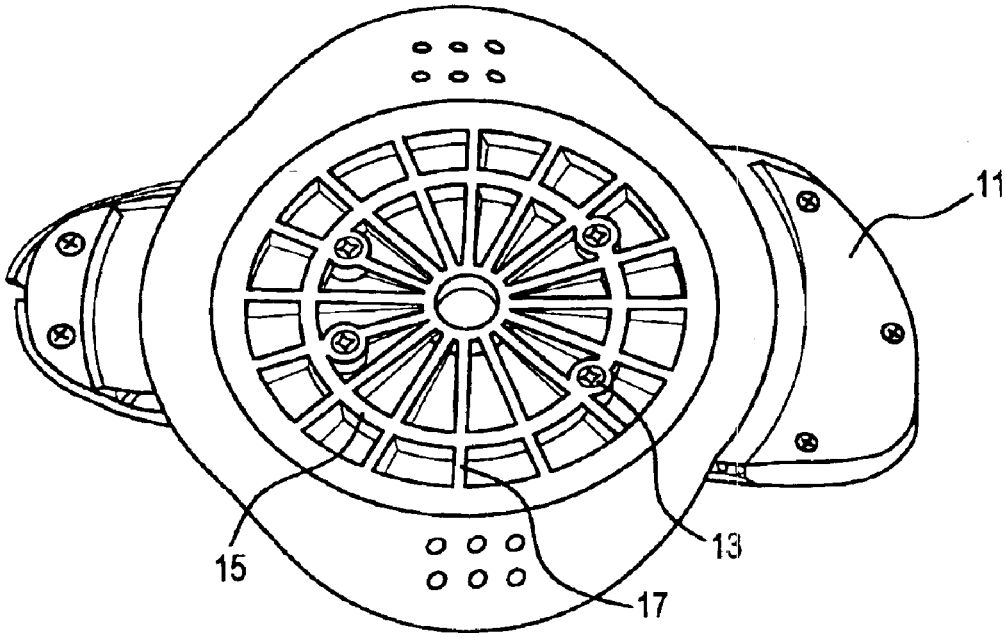
FIG. 3 is a bottom view of the binding plate assembly of FIG. 1 as attached to a boot assembly.

Referring to FIGS. 2 and 3, the binding plate assembly 10 includes a disc 5 and a ring 7. The disc 5 is circular in shape and has holes 9 which facilitate attachment to the base plate 11 of the boot assembly using fasteners 13. The disc 5 is constructed with circumferential ribs 15 and radial ribs 17 on an underside for strength purposes. Other configurations could be used as well.

Figure 4:
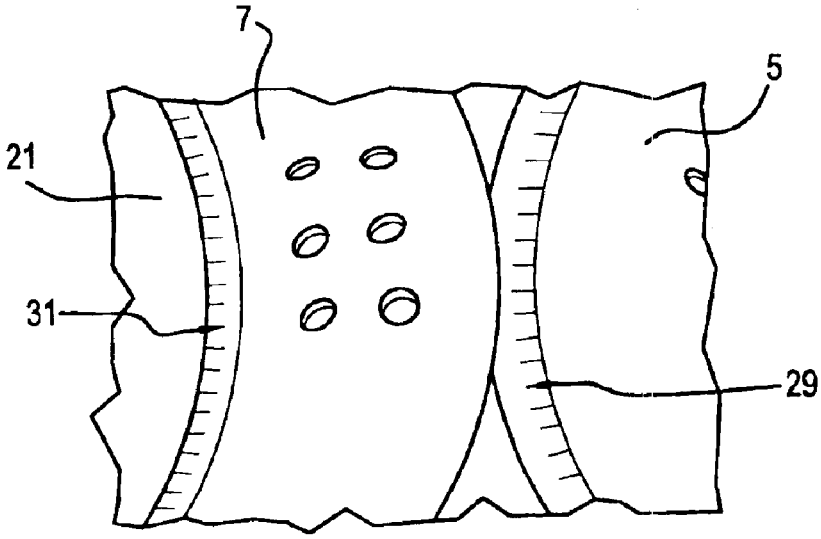
FIG. 4 is a partial view of a bottom surface portion of a ring and top surface portion of a disc of the binding plate assembly of the invention.

The ring 7 forms a central opening 21, partially seen in FIG. 4 and opposing ears 23. Each ear 23 has a number of holes 25, one in each of the ears 23 adapted to receive a fastener 27, see FIG. 1, to secure the ring 7 to the wakeboard 1. The plurality of holes allows for further adjustment of the ring 7 with respect to the wakeboard to increase the number of orientations available to the user of the wakeboard. While a number of holes are shown, each ear could have just one hole. These multiple holes also allow heel-to-toe adjustment of the wakeboard binding.

Referring to FIG. 4, the outer periphery of the disc 5 has teeth 29 in an upper surface thereof. A set of complementary teeth 31 is formed along a peripheral edge of the ring central opening and in an underside surface. The teeth 29 and 31 are designed to engage each other to hold the disc 5 in place with respect to the ring 7. While teeth are employed, virtually any irregular surface that would allow the ring and disc to mesh with each other to inhibit relative movement can be employed.

In use, the disc 5 is positioned to fit within the central opening 21 of the ring 7. The disc is then fastened to the base plate 11 of the boot assembly 3, such that the ring 7 is sandwiched between the disc 5 and the boot assembly 3, see FIG. 3. With the boot assembly 3 attached, the disc 5 is rotated in the proper orientation and the ring 7 is then secured to the wakeboard using the fasteners 27. This is repeated to install a second boot assembly on the wakeboard 1. A user's feet can then slip into the boot assemblies for use of the wakeboard.

The inventive binding assembly offers an easy adjustment technique, whereby an end of the fastener 27 can be grasped by the user, and loosened. Loosening of the fastener allows the ring 7 to be raised up from the disc 5, and the disc 5 can rotate to another position as desired by the user. The fasteners 27 are then retightened, and the wakeboard is ready for use. Loosening and retightening of the ring allows the opposing teeth 29 and 31 to disengage for rotation of the disc 5, and re-engage to hold the disc 5 in place. Of course, the adjustment can be accomplished without a user's feet in the boot.

Figure 5:
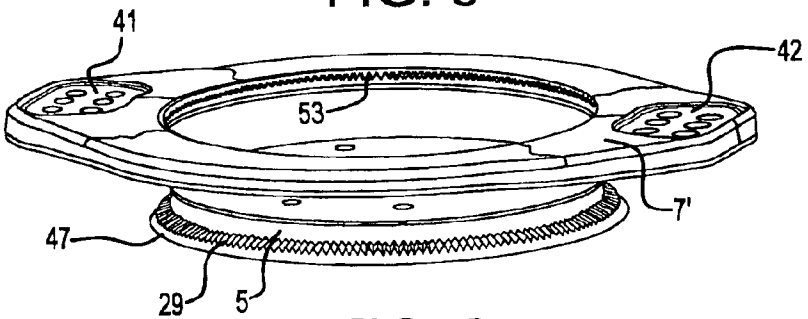
FIG. 5 is a perspective view of the ring and disc in an exploded configuration.
Figure 6:
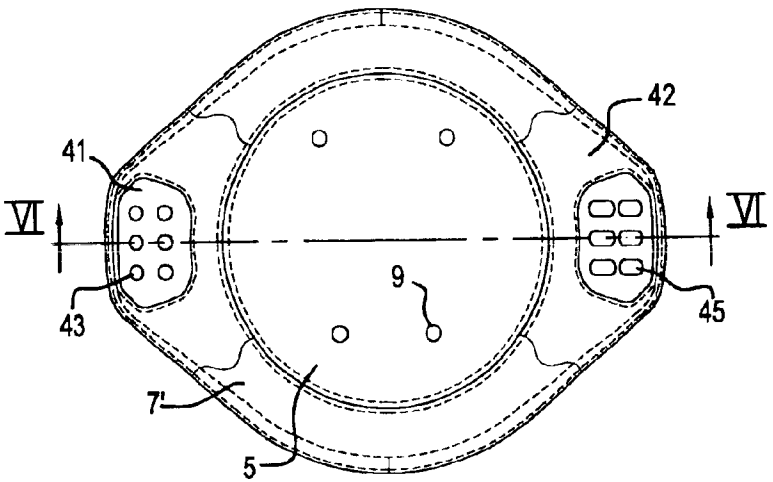
FIG. 6 is a top view of the ring of FIG. 5.
Figure 7:
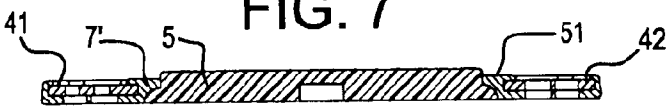
FIG. 7 is a cross sectional view along the line VI-VI of FIG. 6.

FIGS. 5–7 show an alternative embodiment of the invention. In this embodiment, a ring 7' uses overmolded metal inserts 41,42 rather than holes in the ring itself to permit attachment to and positioning of the ring 7' to the wakeboard 1. More specifically, the ring 7' is molded around the metal inserts 41,42 with the metal inserts providing more strength when securing the ring 7' to a wakeboard. The inserts 41,42 are made with circular holes 43 or oblong holes 45, but other shaped openings can be employed as could the same openings in each insert.

As shown in FIGS. 5 and 7, the disc 5 has a lip 47 with the lip upper surface having teeth 29. The ring 7' also employs a lip 51 with teeth 53.

As shown in FIG. 7, the ring 7' sits on the disc 5, and although not shown, the base plate of a boot assembly would sit on the top of the disc. Again, raising the ring 7' allows the disc to rotate to another position.

The ring 7 or 7' may have shapes other than the one disclosed with the opposing ear portions. For example, the ring could be strictly annular in shape, so that the ring width is constant and the holes 25 are located in the desired locations. Likewise, the shape of the throughholes may also vary from the illustrated circular and oblong ones to any other shape that may be conducive to adjusting the position of the ring 7 or 7'. Likewise, the disc 5 can employ other arrangements of throughholes, strengthening ribs, the lip and teeth arrangement to accommodate different designs of the base of the boot assembly.

Although teeth are used so that the rings 7 and 7' and disc 5 engage to prevent disc rotation, other types of irregular surfaces could be employed so that the outer periphery of the top surface of the disc and top surface periphery of the central opening effectively engage to restrain movement of the disc.

The inventive binding plate can be made from virtually any material, metal, polymers, composites, and combinations thereof. Polymers, such as nylon or the like are preferred for their strength and resistance to the effects of water. The ring and disc can be made using any conventional techniques depending on the type of material being used. If the ring is metal, the manufacturing methods, may involve stamping, machining, etc. Molding techniques such as compression, injection, etc. may be employed when using polymers as materials of construction.

The binding plate is illustrated in a binding system that employs horizontal fasteners to retain the boot to its base. However, virtually any binding system employing some type of a base or sole plate that would link to the disc of the inventive binding plate can be used with the invention. Likewise, although holes and fasteners are shown in the disc to attach to the plate of the boot assembly, other modes could be used for attachment purposes, clamps, pins, or combinations of components.

As such, an invention has been disclosed in terms of preferred embodiments thereof which fulfills each and every one of the objects of the present invention as set forth above and provides a new and improved wakeboard binding plate assembly, and its use in a wakeboard binding, and a method of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. In a wakeboard binding having a base plate and a boot assembly, wherein the base plate is adapted to attach to a wakeboard, the improvement comprising:

a) a ring defining a central opening, and at least a pair of opposing throughholes; the ring having top and bottom surfaces, a portion of bottom surface at an edge of the central opening having a first irregular surface; the ring adapted to be secured to the wakeboard using the opposing throughholes; and b) a disc sized larger than the central opening and having top and bottom surfaces, a portion of the top surface of the disc at a peripheral edge thereof having a second irregular surface, the disc including means to permit attachment to the boot assembly, the first and second irregular surfaces adapted to engage each other when the ring is secured to the wakeboard.

2. The wakeboard binding of claim 1, wherein the ring has opposing sets of throughholes to allow for adjustment of the ring on the wakeboard.

3. The wakeboard binding of claim 1, wherein the first and second irregular surfaces are teeth.

4. The wakeboard binding of claim 2, wherein the first and second irregular surfaces are teeth.

5. The wakeboard binding of claim 1, wherein the ring has opposing ears, each ear having one or more of the opposing throughholes.

6. The wakeboard binding of claim 2, wherein the ring has opposing ears, each ear having one or more of the opposing throughholes.

7. The wakeboard binding of claim 1, wherein the means for attaching the disc to the boot assembly include holes in the disc for fasteners.

8. A wakeboard binding plate assembly comprising:

a) a ring defining a central opening, and at least a pair of opposing throughholes; the ring having top and bottom surfaces, a portion of the bottom surface at an edge of the central opening having a first irregular surface; the ring adapted to be secured to a wakeboard using the opposing throughholes; and b) a disc sized larger than the central opening and having top and bottom surfaces, a portion of the top surface of the disc having a second irregular surface, the disc having means to permit attachment to a boot assembly of a wakeboard binding, the first and second irregular surfaces adapted to engage each other when the ring is secured to the wakeboard.

9. The wakeboard binding plate of claim 8, wherein the ring has opposing sets of throughholes to allow for adjustment of the ring on the wakeboard.

10. The wakeboard binding plate of claim 8, wherein the first and second irregular surfaces are teeth.

11. The wakeboard binding plate of claim 9, wherein the first and second irregular surfaces are teeth.

12. The wakeboard binding plate of claim 8, wherein the ring has opposing ears, each ear having one or more of the opposing throughholes.

13. The wakeboard binding of claim 8, wherein the means for attaching the disc to the boot assembly include holes in the disc for fasteners.

14. A method of positioning a boot assembly of a wakeboard binding on a wakeboard comprising the steps of:

a) providing a binding plate assembly as part of the wakeboard binding, wherein the binding plate assembly further comprises:

i) a ring defining a central opening, and having at least a pair of opposing throughholes; the ring having top and bottom surfaces, a portion of bottom surface at an edge of the central opening having a first irregular surface; and ii) a disc sized larger than the central opening and having top and bottom surfaces, a portion of the top surface of the disc having a second irregular surface;

b) attaching the disc to a boot assembly of the binding with the ring disposed between the boot assembly and the disc; and c) attaching the ring to the wakeboard so that the first and second irregular surfaces engage to retain the disc and boot assembly in a desired orientation with respect to the wakeboard.

15. The method of claim 14, wherein the ring is loosened or removed from the wakeboard, the disc is rotated into another position, and the ring is attached or retightened to the wakeboard to reposition the boot assembly.

16. The method of claim 14, wherein the binding plate assembly is provided with opposing sets of throughholes to allow for adjustment of the ring on the wakeboard.

17. The method of claim 14, wherein the binding plate assembly is provided with teeth as the first and second irregular surfaces.

18. The method of claim 14, wherein the ring of the binding plate is provided with opposing ears, each ear having one or more of the opposing throughholes.

19. The method of claim 14, wherein the disc includes throughholes and the disc is attached to the boot assembly using fasteners extending through the throughholes and into the boot assembly.

* * * * *